US006431980B1

(12) United States Patent
Achen

(10) Patent No.: US 6,431,980 B1
(45) Date of Patent: Aug. 13, 2002

(54) COMBUSTION AIR SECURITY VENT

(76) Inventor: John J. Achen, 12432 Del Rico, Yuma, AZ (US) 85367

( * ) Notice: Subject to any disclaimer, the term of this patent is extended or adjusted under 35 U.S.C. 154(b) by 0 days.

(21) Appl. No.: 09/746,382

(22) Filed: Dec. 21, 2000

(51) Int. Cl.[7] ..... F24F 7/00
(52) U.S. Cl. ..... 454/271; 454/276
(58) Field of Search ..... 454/270, 271, 454/276, 277; 52/198, 199, 302.1

(56) References Cited

U.S. PATENT DOCUMENTS

| | | | | | |
|---|---|---|---|---|---|
| 637,519 | A | * | 11/1899 | Mertins | 454/48 |
| 2,790,376 | A | * | 4/1957 | Kennedy et al. | 454/48 |
| 2,930,309 | A | | 3/1960 | Prager | 98/118 |
| 3,740,934 | A | * | 6/1973 | Shuler | 454/48 |
| 3,964,376 | A | * | 6/1976 | Janke | 454/48 |
| 4,592,271 | A | | 6/1986 | Young | 98/114 |
| 4,676,145 | A | | 6/1987 | Allred | 98/29 |
| 4,754,696 | A | | 7/1988 | Sarazen et al. | 98/29 |
| 4,770,087 | A | | 9/1988 | Danley et al. | 98/87 |
| 4,911,066 | A | * | 3/1990 | Carew | 454/48 |
| 5,120,273 | A | | 6/1992 | Lin | 454/195 |
| 5,194,038 | A | * | 3/1993 | Klomhaus et al. | 454/162 |
| 5,349,799 | A | | 9/1994 | Schiedegger et al. | 52/473 |
| 5,487,701 | A | | 1/1996 | Schedegger et al. | 454/271 |
| 5,758,457 | A | | 6/1998 | Achen | 52/198 |
| 5,976,007 | A | * | 11/1999 | Powell et al. | 454/48 |
| 5,976,009 | A | | 11/1999 | Achen | 454/195 |
| 6,113,488 | A | * | 9/2000 | Tiede | 454/276 |

OTHER PUBLICATIONS

Brochure entitled "Clopay 4200/4201—Steel Insulated Raised Panel & Flush Garage Doors", by Clopay Corporation, 1993, (4 pages).

Catalog entitled "POLAR Hardware Mfg. Co., Inc.", Catalog No. 90, Chicago, Illinois (cover page, p. 69 and last page), undated.

* cited by examiner

*Primary Examiner*—Harold Joyce
*Assistant Examiner*—Derek S. Boles
(74) *Attorney, Agent, or Firm*—Cahill, Sutton & Thomas, P.L.C.

(57) ABSTRACT

A vent assembly for mounting in a passageway extending through an exterior wall to provide ventilation to the space bounded by the exterior wall includes an apertured panel exteriorly juxtaposed with a security grate to prevent unauthorized intrusion through the exterior wall. Carriage bolts extend through the apertured panel and security grate into engagement with an anchoring element, such as brackets disposed in the passageway. In addition or in the alternative screws penetrably engaging the security grate may be attached directly to the exterior wall laterally of the passageway. The smooth surfaced head of the carriage bolts, coupled with the square cross-section of the shank adjacent the head mating with square apertures in the apertured panel and in the security grate prevent turning of the carriage bolts from a location external to the exterior wall. For further security, the louvered vent may be configured to overlap and shield the heads of the screws, if used. To further define the boundary of the passageway, a shroud disposed within the passageway may be employed. The interior end of the passageway may be left opened or covered with a vented panel whereby the vent assembly provides combustion air to a gas fired heater or other oxygen consuming device within the space bounded in part by the exterior wall.

32 Claims, 4 Drawing Sheets

COMBUSTION AIR SECURITY VENT

CROSS-REFERENCE TO RELATED APPLICATIONS

The invention is related to the inventions described in U.S. Pat. No. 5,758,457 entitled "Vent With Security Gate" issued on Jun. 2, 1998, and U.S. Pat. No. 5,976,009 entitled "Vent With Multi-Apertured Security Gate" issued on Nov. 2, 1999 by the present inventor.

BACKGROUND OF THE INVENTION

1. Field of the Invention

The present invention relates to vent assemblies and, more particularly, to a vent assembly for an enclosed area and having a security grate for preventing access through a juxtaposed passageway.

2. Description of Related Art

During the summer time in the southwest, the temperature in an unvented enclosed garage increases to well over 100 degrees. Such a high temperature may cause damage or deterioration to temperature sensitive items stored or otherwise disposed within such garage. Moreover, the high temperature renders it very uncomfortable for persons working within the garage. To alleviate this problem, it is common to cut one or more apertures in a garage door and cover such aperture with a multi-louvered screened vent readily available in hardware stores. Such vents permit convective airflow through the garage door and generally restrain intrusion of larger sized insects.

Because the commercially available vents are usually of aluminum or light sheet metal, they are easily destroyed to permit access to the juxtaposed aperture. The now accessible aperture permits a child or small adult to pass therethrough and permits use of extended tools and the like to unlock and open the garage door. The resulting accessibility to the garage and its contents is an invasion of privacy and promotes burglary. The garage owner, and particularly a homeowner having such a vented garage door, is therefore faced with the quandary of either accepting an unreasonably hot garage or risk intrusion.

To encourage airflow into and out of a garage through a closed garage door, one or more of the conventional types of vents are often located close to the bottom and to the top of the garage door. Such positioning permits escape of hot air through the upper vents due to convection and a compensatory inflow of cooler air through the bottom vents. Such plurality of apertures promotes air circulation with attendant cooling benefits but also provide a plurality of locations for intrusion into the confines of the garage.

Many residential garages have gas fired water heaters located therein. These heaters require make up air to provide a continuing source of oxygen to maintain combustion. Often, vents attached with screws accessible from the outside of an exterior wall, door or garage door are used to establish the requisite air flow. Because of the manner of attachment of these vents, they are easily removed by an intruder and access to the interior of the garage becomes possible.

Many municipalities are redrafting or adopting a building code requiring vents in an exterior wall of a garage within twelve (12") inches of the ceiling and of the floor to insure an adequate source of make up air. Alternatively, such vents may be located in the garage door itself.

SUMMARY OF THE INVENTION

To prevent physical intrusion of a human body through a venting aperture or passageway in an exterior wall of a garage, a security grate is positioned adjacent the aperture and inwardly of a conventional louvered vent. Fastening means, such as carriage bolts, extending through square or slotted holes in the louvered vent and security grate and retained by nuts to a bracket, secure the security grate in place while preventing unthreading of the bolts. Alternatively, the fastening means may be threadedly engaged with wall studs of the exterior wall and defining the passageway of the vent. Preferably, the security grate is a sheet of iron or steel of sufficient thickness to prevent destruction by conventional tools. The apertures in the security grate are limited in size to preclude passthrough of tools for creating access to the garage. That is, the apertures minimize the likelihood of intrusion of a tool to unlock the garage door by manipulation of the tool through the security grate. To more securely attach the vent and security grate, a shroud may be formed to define the confines of the passageway within the wall and prevent enlargement of the passageway and subsequent removal of the vent and security plate. A louvered panel may be disposed at the interior end of the passageway to prevent placing elements within the passageway and thereby reduce air flow therethrough and for aesthetic purposes.

It is therefore a primary object of the present invention to provide a vent assembly for introducing combustion air through an exterior wall while preventing intrusion therethrough.

Another object of the present invention is to provide a vent assembly for preventing intrusion through a venting passageway of an exterior wall.

Still another object of the present invention is to provide a security grate attendant an aperture in an exterior wall to accommodate venting of the space interior of the exterior wall while preventing intrusion into the space.

A further object of the present invention is to provide a vent assembly for an exterior wall to prevent intrusion and which vent assembly is not dismantleable from the exterior of the exterior wall.

A yet further object of the present invention is to provide a vent assembly with a bracket located within a passageway in a wall that secures a security grate of the vent assembly.

A still further object of the present invention is to provide a method for preventing intrusion through an exterior wall while accommodating venting.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
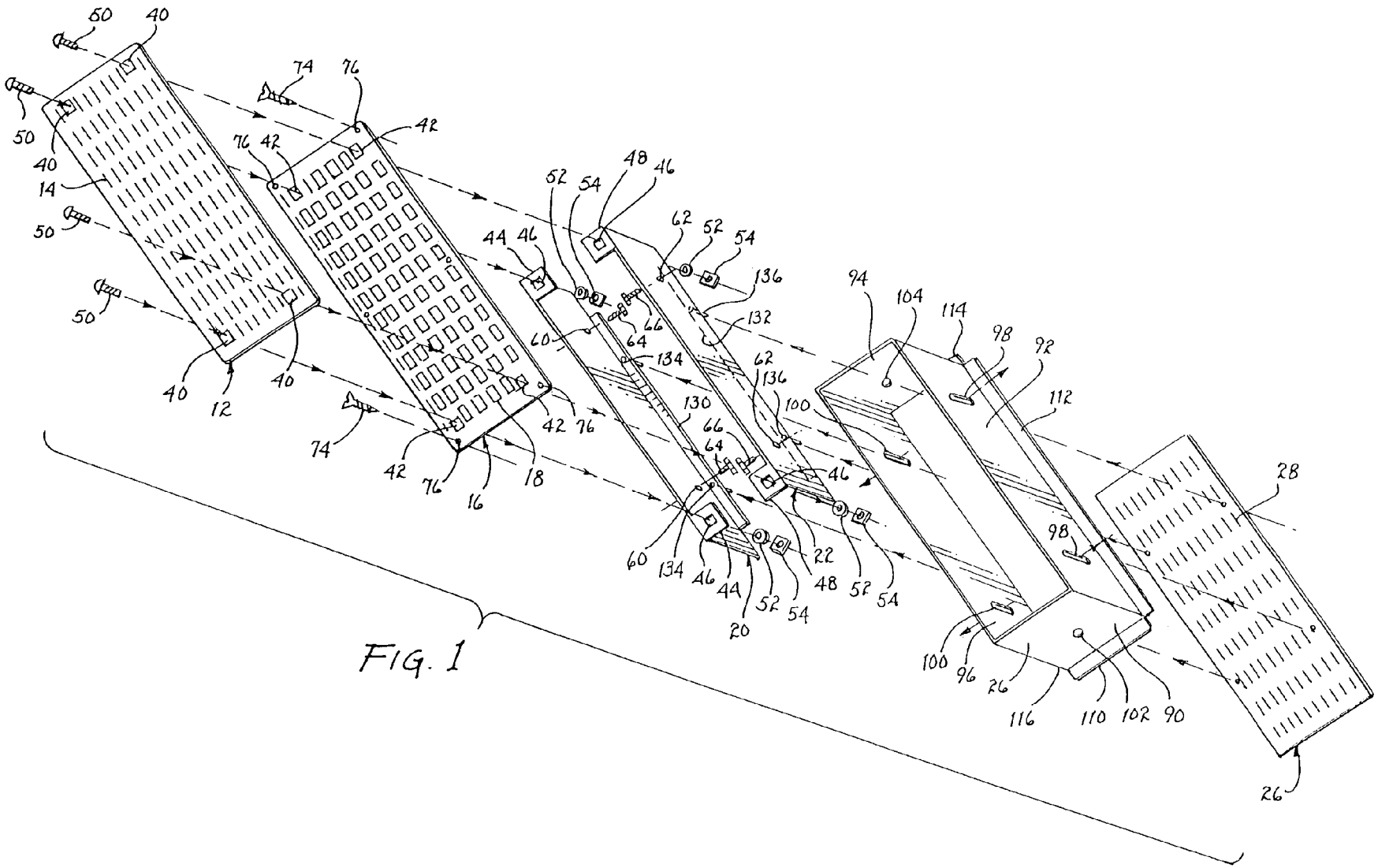
FIG. 1 is an exploded view of the elements of a vent assembly mountable in an exterior wall.

Referring to FIG. 1, there is illustrated in an exploded view certain components of a vent assembly 10 mountable within a passageway in an exterior wall of a building to permit airflow through the exterior wall. For example, such exterior wall may be a wall circumscribing in part a garage wherein a gas fired heater or the like is located. The vent assembly includes an apertured panel 12 having downwardly directed louvers 14 for permitting airflow therethrough but restraining inflow of rainwater. A security grate 16 is located adjacent apertured panel 12 and includes a plurality of slots or apertures 18 for accommodating airflow through the security grate but which are of sufficiently small size to preclude insertion of a tool usable to initiate raising of a garage door or the like. A pair of brackets 20, 22 are mountable within the passageway through the exterior wall. These brackets are secured to the passageway and serve as anchors for attaching apertured panel 12 and security grate 16. A four sided shroud 24 may be mounted within the passageway to define its boundary. It may also serve as an anchor for attaching an interior panel, such as panel 26.

Referring jointly to FIGS. 1, 2, 3 and 4, further details of vent assembly 10 will be described. Apertured panel 12 includes a square hole 40 mounted close to each corner of the apertured panel. Similarly, security grate 16 includes a square hole 42 mounted close to each corner and coincident with respective ones of square holes 40 in the apertured panel. Bracket 20 includes a pair of upturned tabs 44 containing square holes 46. Similarly, bracket 22 includes downturned tabs 48 having square holes 46 disposed therein. Carriage bolts 50 includes a square cross-section shank adjacent the head, as is common, and the remaining part of the shank is threaded. Each of the carriage bolts extends through corresponding square apertures 40, 42 and 46 with the square cross-sectional shank portion penetrably engaging such apertures. Thereby, the resulting interference between the square cross-sectional shank and the holes precludes rotation of the carriage bolts. A washer 52 and nut 54 penetrably engage each of the carriage bolts to secure apertured panel 12 and security grate 16 with the corresponding tabs of brackets 20 and 22. Each of brackets 20, 22 include one or more apertures 60, 62, respectively, for penetrably receiving lag bolts 64, 66, respectively; alternatively, screws may be used. Thereby, lag bolts 64, 66 secure the brackets to stud 70 or other structural members of wall 72 to provide a foundation for retaining security grate 16 in place. As is evident from FIG. 2, any attempt to remove carriage bolts 50 by rotating the head of one or more of the carriage bolts will be fruitless. The only way in which the carriage bolts can be loosened is that of rotating nut 54 relative to its respective carriage bolt.

To further stabilize the attachment of security grate 16 to the passageway in the exterior wall, screws 74 may be used. Preferably, screw 74 is a countersunk screw penetrably engaging a countersunk hole 76 in each of the corners of security grate 16. Each of screws 74 threadedly engages structural members of wall 72, which structural members may be studs 70 or the like. As particularly shown in FIG. 2, wall 72 may include one or more exterior panels 77, 78 adjacent structural members 70, which may be vertical studs or horizontal cross-members. Apertured panel 12 includes a peripheral flange 80 bent approximately 45 degrees toward wall 72. This flange shields the perimeter of security grate 16. Furthermore, the flange discourages outward bending of the apertured panel to permit access to screws 74. Thus, screws 74 are shielded by apertured panel 12 and discourage dismantling of the security grate from the supporting wall.

It is to be understood that for installations wherein impossibility of unauthorized removal of security grate 16 is not of paramount importance, brackets 20, 22 may be eliminated. In such installation, screws 74 serve as the primary anchoring mechanisms for retaining the security grate in place. The attachment of the apertured panel to the security grate may be with the carriage bolts shown, or with other nut and bolt assemblies, rivets, etc. Furthermore, the shielding provided by apertured panel 12 serves as a deterrent against unauthorized removal of the security grate.

Figure 2:
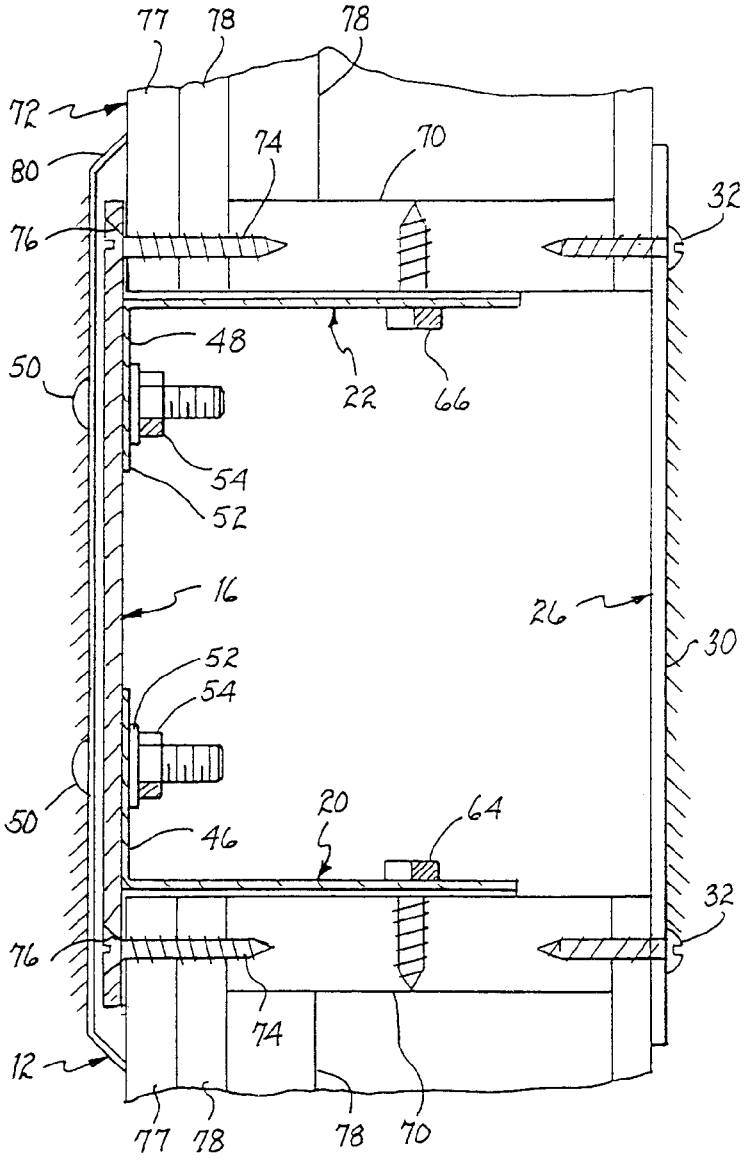
FIG. 2 is a cross-sectional view of the vent assembly.

As shown in FIGS. 1 and 2, a panel 26 includes a plurality of slots 28 (as shown in FIG. 1), which may include louvers 30, as shown in FIG. 2, to permit airflow through vent assembly 10. Panel 26 may be attached to the interior surface of exterior wall 72 by screws 32, or the like, engaging elements of the exterior wall, such as studs 70. The main purpose for panel 26 is to prevent placement of objects within vent assembly 10 or in the passageway that may impede airflow therethrough. Furthermore, the panel provides an aesthetic benefit.

Figure 4:
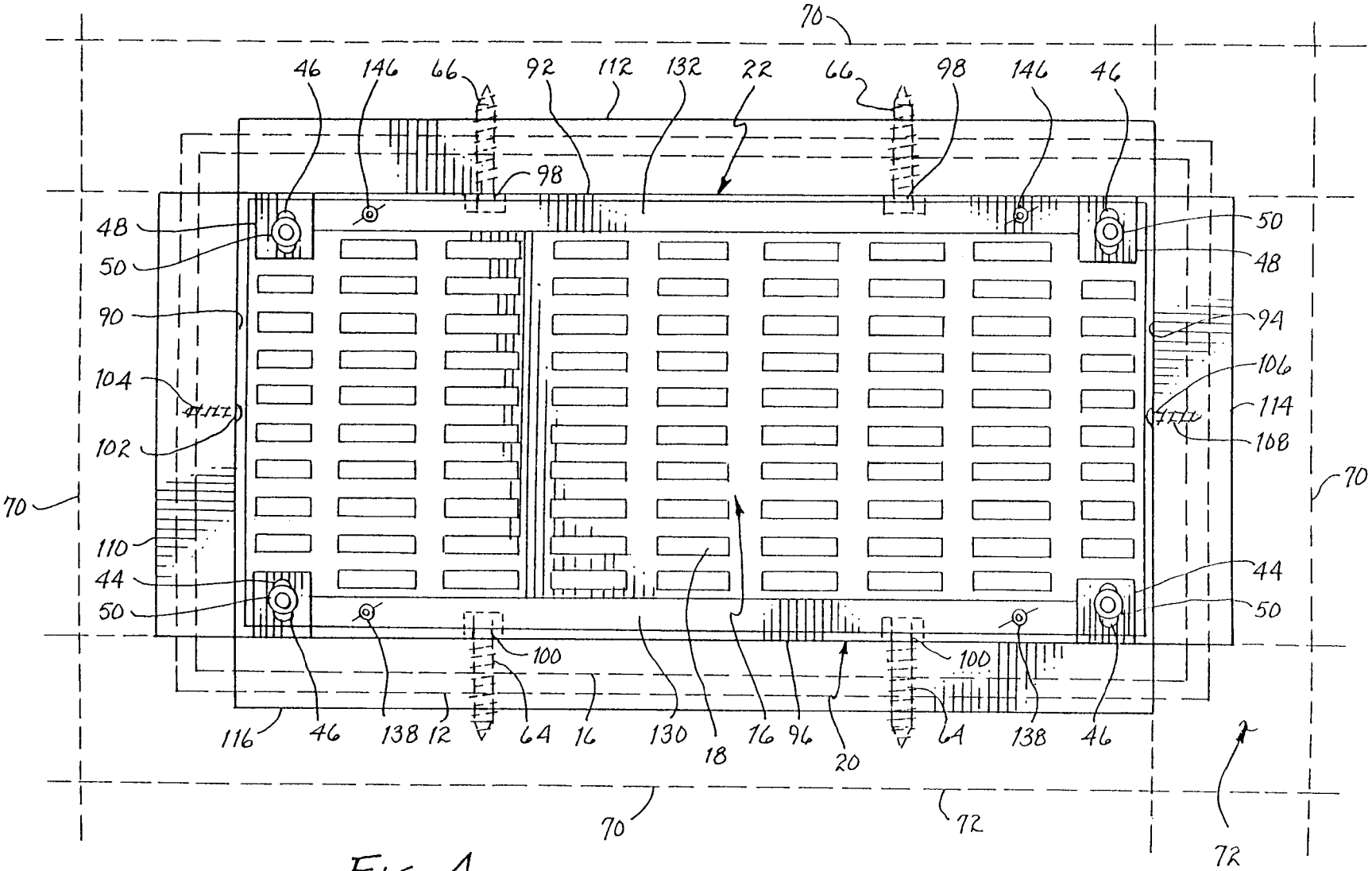
FIG. 4 is a rear view of the vent assembly shown in FIG. 1.

Referring jointly to FIGS. 1 and 4, there is illustrated a shroud 24. The shroud may be a single unit having four walls or it may be configured as four panels 90, 92, 94, 96 forming the essentially rectangular shroud. Panel 92 includes slots 98 for accommodating penetrable insertion of lag bolts 66. Similar slots 100 are formed in panel 96 to accommodate lag bolts 64. Panel 90 may include an aperture 102 for receiving a lag bolt 104 or the like to retain the panel against a corresponding surface within the passageway in exterior wall 72. Panel 94 includes a similar aperture 106 for securing the panel with a lag bolt 108 to a corresponding surface within the passageway in exterior wall 72. Each of panels 90, 92, 94, 96 may include a 90 degree (90°) flange, 110, 112, 114, 116, respectively, to bear against the interior wall surface of exterior wall 72 to limit the degree of insertion of the respective panel and to permit attachment by driving a nail or inserting a screw (not shown) therethrough into the underlying surface of the exterior wall. Moreover, such screw may be used to also attach panel 26. A main function of shroud 26 is that of defining the passageway through the exterior wall in the event such passageway is not already defined by structural members. Thereby, access to sections of the exterior wall lateral of the passageway is precluded.

Figure 3:
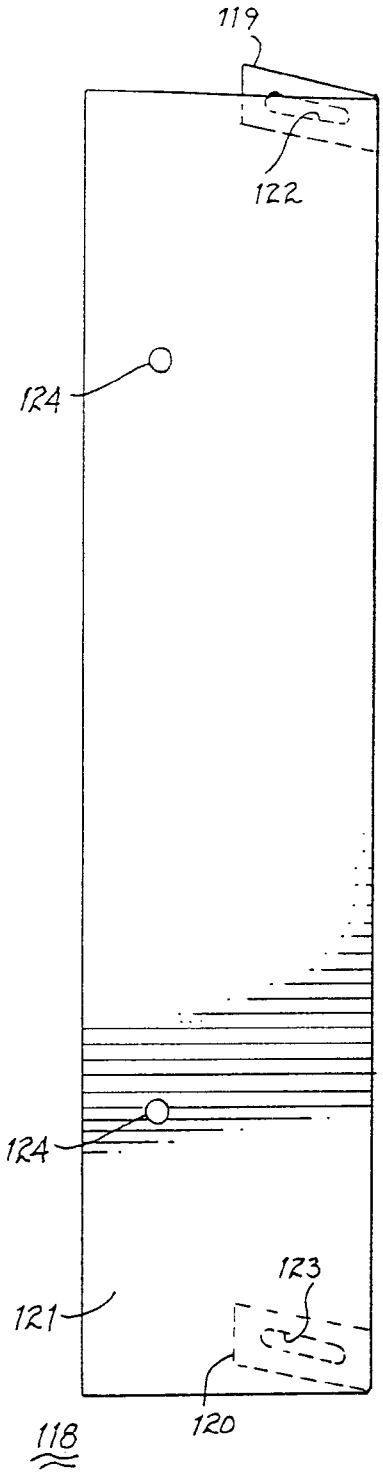
FIG. 3 is an isometric view of a variant bracket of the vent assembly shown in FIG. 1.

Referring to FIG. 3, there is illustrated a variant bracket 118. This variant bracket may be substituted for either or both of brackets 20, 22 described above. In variant bracket 118, elongated tabs 119, 120 extend from the front edge of a plate 121. Each of tabs 119, 120 includes an elongated slot 122, 123, respectively. The width of each of slots 122, 123 is commensurate with the dimension of opposed walls of the square shank section of carriage bolts 50 whereby a carriage bolt inserted within one of these slots is precluded from turning. Plate 121 includes apertures 124 for securing variant bracket 118 to a corresponding surface defining the passageway through exterior wall 72. The purpose of elongated slots 122, 123 is that of accommodating different vertical positions of holes 40 in aperture panel 12 and holes 42 in security grate 16.

Figure 6:
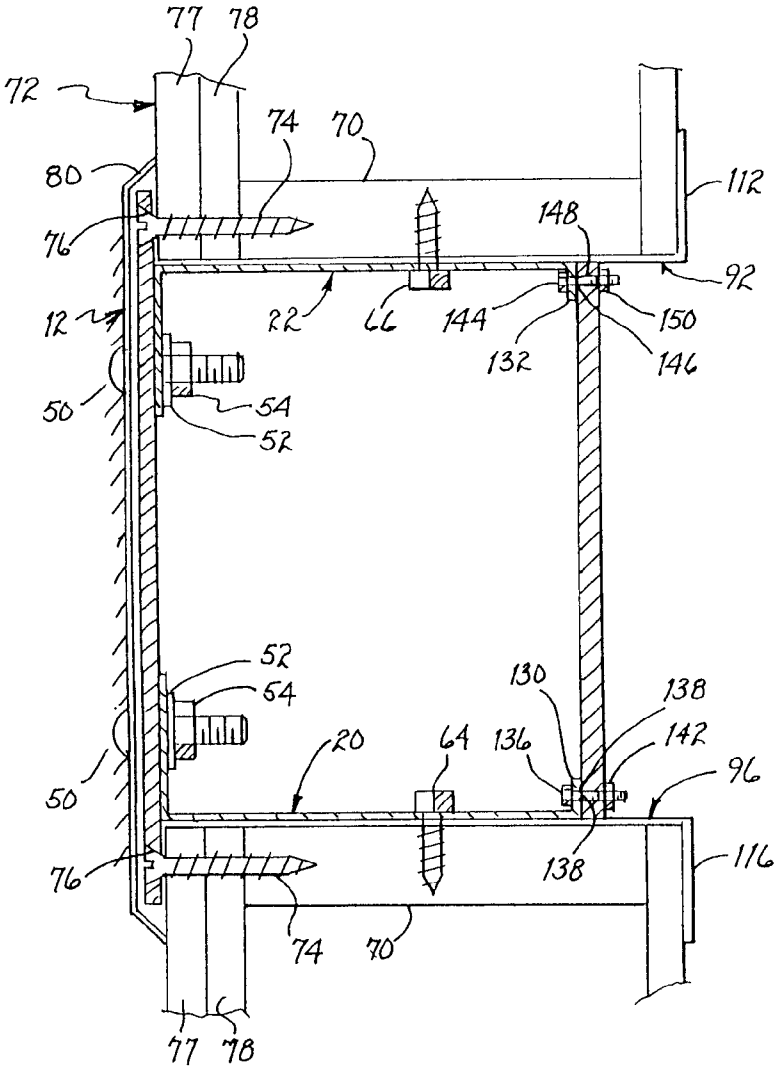
FIG. 6 is a cross-sectional view illustrating a variant of the vent assembly.

As shown in FIGS. 4 and 6, brackets 20, 22 may include rear lips 130, 132. These lips include apertures 134. The purpose of lips 130, 132 is to provide a mounting for a panel 134. In particular, this panel is secured to lip 130 by bolt 136 extending through an aperture 138 in the lip and through a passageway 140 extending through the panel and into threaded engagement nut 142. Similarly, panel 134 is secured to lip 132 by bolt 144 extending through aperture 146 in the lip and through passageway 148 in the panel and into threaded engagement nut 150. Alternatively, sheet metal screws not requiring a nut could be used to simplify the installation. Panel 134 may be apertured to permit airflow through vent assembly 10. Alternatively, it may be transparent or translucent to permit passage of light through the vent assembly during periods when ventilation or combustion air is not needed within the garage or other space bounded by exterior wall 72. Or, the panel may be of insulative material to reduce heat transfer through the vent assembly. It is to be noted that FIG. 6 also illustrates in cross-section panel 92 and its flange 112 and panel 96 and its flange 116.

Figure 5:
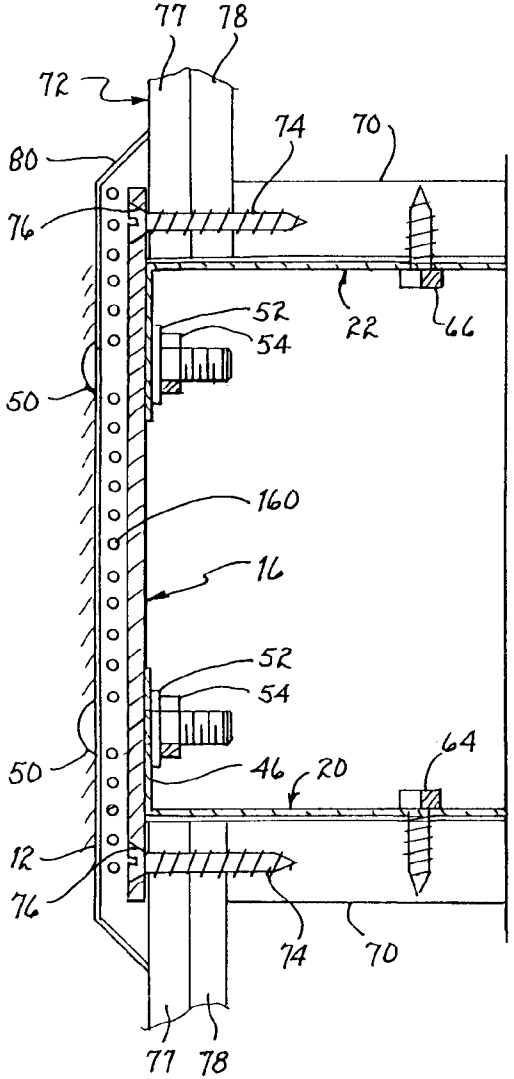
FIG. 5 is a partial cross-sectional view of the vent assembly illustrating a screen.

FIG. 5 illustrates a variant of vent assembly 10 shown in FIG. 2. That is, a screen 160 is disposed intermediate apertured panel 12 and security grate 16 to preclude insects and the like from entering the vent assembly. To accommodate the thickness of screen 160, angled flange 80 may be extended laterally from the configuration illustrated in FIG. 2 in order to accommodate the thickness of screen 160 and still have the flange bear against the exterior surface of exterior wall 72 to shield the edge of security grate 16. It is to be understood that the screen may also be placed intermediate the security grate and the exterior wall.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A combustion air vent assembly for use with an aperture at the exterior end of a passageway extending therethrough an exterior wall of a building, said assembly comprising in combination:

a) an apertured panel for permitting airflow therethrough;

b) a security grate comprising a rigid apertured plate and adapted to extend across the aperture of the passageway for preventing intrusion through the passageway;

c) at least one bracket adapted to be in the passageway for retaining said security grate in place; and d) attaching means adapted to secure said apertured panel and said security grate to one another and to said at least one bracket and in juxtaposed relationship with the aperture of the passageway.

2. The vent assembly as set forth in claim 1 including a panel extending across an aperture at the interior end of the passageway in the panel to permit airflow through the passageway and retaining means for securing said panel in place.

3. The assembly as set forth in claim 1 wherein said attaching means comprises carriage bolts.

4. The assembly as set forth in claim 3 wherein said attaching means includes means adapted for securing said security plate to the exterior wall.

5. The assembly as set forth in claim 1 wherein said at least one bracket comprises a pair of brackets adapted to be disposed on opposed sides of the passageway.

6. The assembly as set forth in claim 1 including a shroud adapted to be disposed within the passageway.

7. The assembly as set forth in claim 6 wherein said shroud supports said at least one bracket.

8. The assembly as set forth in claim 3 wherein each of said apertured panel and said security grate includes square holes for penetrably receiving said carriage bolts.

9. The assembly as set forth in claim 8 wherein said at least one bracket comprises a pair of brackets.

10. A method for preventing ingress through a passageway extending through an exterior wall of a building while accommodating flow of combustion air through the passageway, said method comprising the steps of:

a) locating an apertured panel across an opening of the passageway and generally coincident with the exterior surface of the exterior wall;

b) positioning a security grate in juxtaposed relationships with the apertured panel;

c) engaging the apertured panel and the security grate with carriage bolts extending through holes in the apertured panel and in the security grate toward the interior of the exterior wall;

d) preventing rotation of the carriage bolts upon penetrable insertion through the apertured panel and the security grate; and e) securing each of the carriage bolts to a bracket disposed within the passageway.

11. A method as set forth in claim 10 including the step of locating a shroud adjacent the surfaces of the passageway.

12. A method as set forth in claim 11 including the step of supporting the brackets upon said shroud.

13. A method as set forth in claim 10 including the steps of supporting a further panel internally of the security grate with the brackets.

14. A method as set forth in claim 10 including the step of locating a screen intermediate the apertured panel and the security grate.

15. A method as set forth in claim 10 wherein the apertured panel includes a peripheral angled flange and including the step of shielding the perimeter of the security grate with the flange.

16. A method for preventing ingress through a passageway extending through an exterior wall of a building while accommodating flow of combustion air through the passageway, said method comprising the steps of:

a) attaching a security grate to the exterior wall surface surrounding the passageway with attachment means;

b) positioning an apertured panel in juxtaposed relationships to the security grate and exteriorly of the security grate; and c) shielding the attachment means with the apertured panel to prevent access to the attachment means.

17. A method as set forth in claim 16 wherein said step of attaching comprises the step of penetrably inserting screws through the security grate into threaded engagement with the exterior wall.

18. A method as set forth in claim 17 wherein said step of shielding comprises the step of covering the heads of the screws with the apertured panel.

19. A method as set forth in claim 16 including the step of locating a screen intermediate the apertured panel and the security grate.

20. A combustion air vent assembly for insertion into a passageway extending through an exterior wall of a building to accommodate a flow of air into the space adjacent the interior surface of the exterior wall, said vent assembly comprising in combination:

a) a security grate adapted to extend across the passageway;

b) at least one bracket adapted to be disposed in the passageway;

c) attachment means for attaching said security grate to said at least one bracket;

d) an apertured panel; and e) further attachment means for attaching said apertured panel in juxtaposed relationship with said security grate and generally coincident with the exterior surface of the exterior wall.

21. The vent assembly as set forth in claim 20 wherein said at least one bracket comprises a pair of brackets adapted to be disposed on opposed sides of the passageway.

22. The vent assembly as set forth in claim 20 including a shroud adapted to be disposed within said passageway.

23. The vent assembly as set forth in claim 22 wherein each bracket of said at least one bracket is adapted to be mounted upon said shroud.

24. The vent assembly as set forth in claim 20 wherein said attachment means and said further attachment means comprise carriage bolts having a section of shank square in crosssection, said security grate including a plurality of apertures square in cross-section for receiving and mating with said section of shank to prevent rotation of said carriage bolts relative to said security grate.

25. The vent assembly as set forth in claim 24 wherein said apertured panel is sized relative to said security grate to overlap said security grate.

26. The vent assembly as set forth in claim 20 including a screen adapted to be located intermediate said security grate and said apertured panel.

27. The vent assembly as set forth in claim 20 including a further panel, each bracket of said at least one bracket including a lip adapted for supporting said further panel.

28. A combustion air vent assembly for engaging a passageway extending through an exterior wall of a building to accommodate a flow of air into the space adjacent the interior surface of the exterior wall, said vent assembly comprising in combination:

a) security grate adapted to extend across the passageway;

b) attachment means for attaching said security grate to the exterior wall;

c) an apertured panel adapted to be juxtaposed with said security grate and to shield said attachment means;

d) at least one bracket adapted to be disposed within and secured to the passageway; and e) further attachment means for securing said apertured panel in juxtaposed relationship with said security grate and to said at least one bracket.

29. The vent assembly as set forth in claim 28 including a screen adapted to be disposed intermediate said security grate and said apertured panel.

30. The vent assembly as set forth in claim 28 wherein said apertured panel includes a peripheral flange adapted to shield the edge of said security grate.

31. The vent assembly as set forth in claim 28 wherein said attachment means comprises screws for penetrable insertion through said security grate and adapted to threadedly engage the exterior wall.

32. The vent assembly as set forth in claim 31 wherein said further attachment means comprises bolts and nuts.

* * * * *